US005138962A

United States Patent [19]

Klundt

[11] Patent Number: 5,138,962

[45] Date of Patent: Aug. 18, 1992

[54] SEWING MACHINE WITH AN UPPER FEED MECHANISM

[75] Inventor: Kurt Klundt, Hirschhorn, Fed. Rep. of Germany

[73] Assignee: G. M. Pfaff Aktiengesellschaft, Kaiserslautern, Fed. Rep. of Germany

[21] Appl. No.: 730,976

[22] PCT Filed: Dec. 6, 1989

[86] PCT No.: PCT/EP89/01493

§ 371 Date: Jul. 24, 1991

§ 102(e) Date: Jul. 24, 1991

[87] PCT Pub. No.: WO90/08850

PCT Pub. Date: Aug. 9, 1990

[30] Foreign Application Priority Data

Jan. 27, 1989 [DE] Fed. Rep. of Germany ..... 3902443

[51] Int. Cl.[5] ..... D05B 29/02; D05B 27/04

[52] U.S. Cl. ..... 112/311; 112/320; 112/237; 112/235; 100/268

[58] Field of Search ..... 112/311, 312, 314, 320, 112/235, 237, 238, 239; 100/268, 257, 258 R, 282, 292; 188/312, 316

[56] References Cited

U.S. PATENT DOCUMENTS 4,187,795 2/1980 Norton ..... 112/320 X
4,462,320 7/1984 Scholl ..... 112/311 X
4,686,917 8/1987 Braun ..... 112/320 X
4,726,309 2/1988 Popp ..... 112/235 X
4,936,235 6/1990 Klundt ..... 112/311 X
4,981,094 1/1991 Stapel et al. ..... 112/235

FOREIGN PATENT DOCUMENTS 8901067 2/1989 European Pat. Off. .
3528295 2/1987 Fed. Rep. of Germany .
8807493 7/1988 Fed. Rep. of Germany .

*Primary Examiner*—Werner H. Schroeder
*Assistant Examiner*—Paul C. Lewis
*Attorney, Agent, or Firm*—McGlew & Tuttle

[57] ABSTRACT

Sewing machine with an upper feed mechanism is provided with a stroke-adjusting system in which the drive connection between the upper feed foot and the presser foot has a three-position control device for automatic adjustment of the height position of the upper feed system. This is preferably a hydraulic control device, whose hydraulic cylinder is subdivided by its adjusting piston into two chambers. A hydraulic difference measuring unit is provided wherein the two chambers 82*a*, 82*b* of the hydraulic cylinder 59 are connected via two antiparallel-connected pressure relief valves 71, 71'. Each pressure relief valve 71, 71' preferably consists of a spring-tensioned check valve R and a pressure-limiting valve D arranged downstream of it.

3 Claims, 4 Drawing Sheets

SEWING MACHINE WITH AN UPPER FEED MECHANISM

FIELD OF THE INVENTION

The present invention pertains to a sewing machine with an upper feed system which consists of an upper feed mechanism having an upper feed foot, a presser foot mechanism having a presser foot, as well as a lifting drive and a pushing drive for the upper feed foot, the feed mechanism having a support which is adjustable in height via a drive connection connected to the housing of the sewing machine, the drive connection including a hydraulic control device.

BACKGROUND OF THE INVENTION

Such a sewing machine is the subject of U.S. Pat. Application No. Ser. 458,701 corresponding to German application P 37,24,786.7-26. It contains a device for automatically adjusting the height position of the upper feed system to the actual working height of the material to be sewn. One possible embodiment of the control device used here is a hydraulic three-position control device. To achieve an idle stroke, this control device has a pre-tensioned spring system arranged between the adjusting piston of the control device and the presser foot as well as the upper feed foot, which spring system produces the range of insensitivity necessary for the three-position control in cooperation with a hydraulic device.

This measure is expensive. The design, which consists of both mechanical and hydraulic components, has a plurality of moving parts which require space and whose hydraulic sealing is expensive.

SUMMARY AND OBJECTS OF THE INVENTION

To improve this device, the basic object of the present invention is to provide a control device whose function is performed predominantly by hydraulic means.

According to the invention, a sewing machine is provided including an upper feed system which consists of an upper feed mechanism having an upper feed foot, a presser foot mechanism having a presser foot, as well as a lifting drive and a pushing drive for the upper feed foot. The upper feed system has a support which is adjustable in height via a drive connection connected to the housing of the sewing machine. The drive connection contains a hydraulic control device with a hydraulic cylinder and an adjusting piston to which the force of reaction arising from the lifting forces acting on the upper feed foot and acting on the presser foot during the sewing process is imparted via a linkage connection. The adjusting piston subdivides the hydraulic cylinder into two chambers. The two chambers are connected to one another via pressure relief means including a first pressure relief valve acting in one direction and a second pressure relief valve acting in another direction (antiparallel-connected pressure relief valves).

The components needed to produce the range of insensitivity are now of a hydraulic nature, as a result of which a simplified, compact design is obtained, and the problems related to sealing are substantially reduced.

The solution according to the invention wherein each pressure relief valve comprises a spring-tensioned check valve and a pressure limiting device arranged downstream of the check valve, leads to an embodiment of simple design of the control device. The measure according to the invention wherein the pressure relief valve contains a sleeve fastened in a hole of the housing of the hydraulic cylinder and each end of this sleeve is connected by an oil passage opening to one of the chambers and a spring-tensioned piston, which is supported by a ball covering and oil passage opening, is displaceably mounted in the sleeve and the piston is arranged in the transition zone to a cross hole in the sleeve, whose diameter is larger than the length of the piston, reduces the mechanism necessary for producing the idle stroke of the control device to a few parts.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
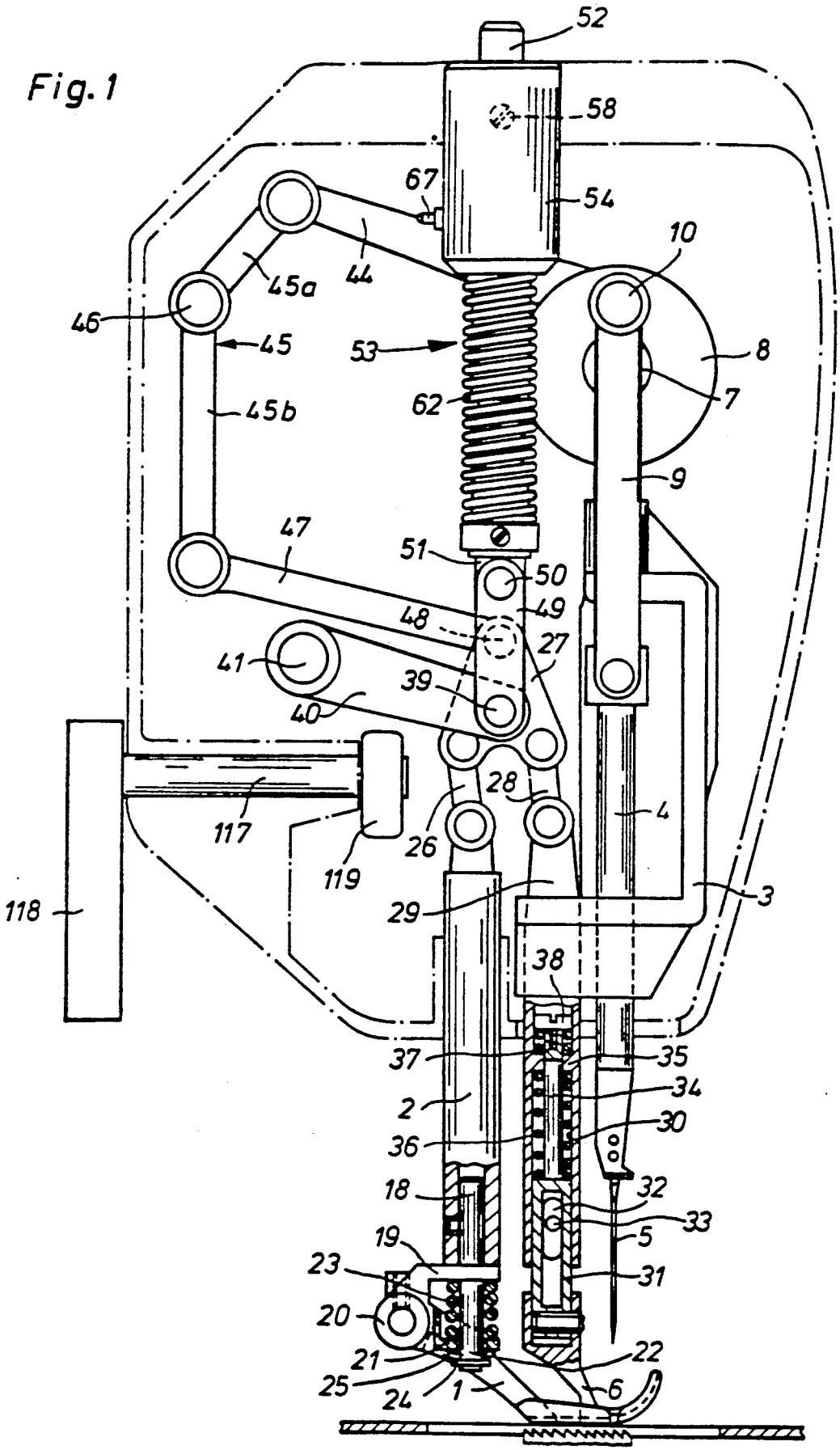
FIG. 1 is a partially cutaway side view of a sewing machine with an upper feed mechanism according to the invention.

FIG. 1 shows the side view of a sewing machine whose housing accommodates a presser foot bar 2 carrying a presser foot 1 and a needle bar 4, which is mounted in a needle bar holder 3 and whose thread-carrying needle 5 cooperates with a shuttle (not shown). To displace the fabric layers to be sewn together, the sewing machine has an upper feed foot 6 which cooperates with a lower feed dog (not shown).

Figure 2:
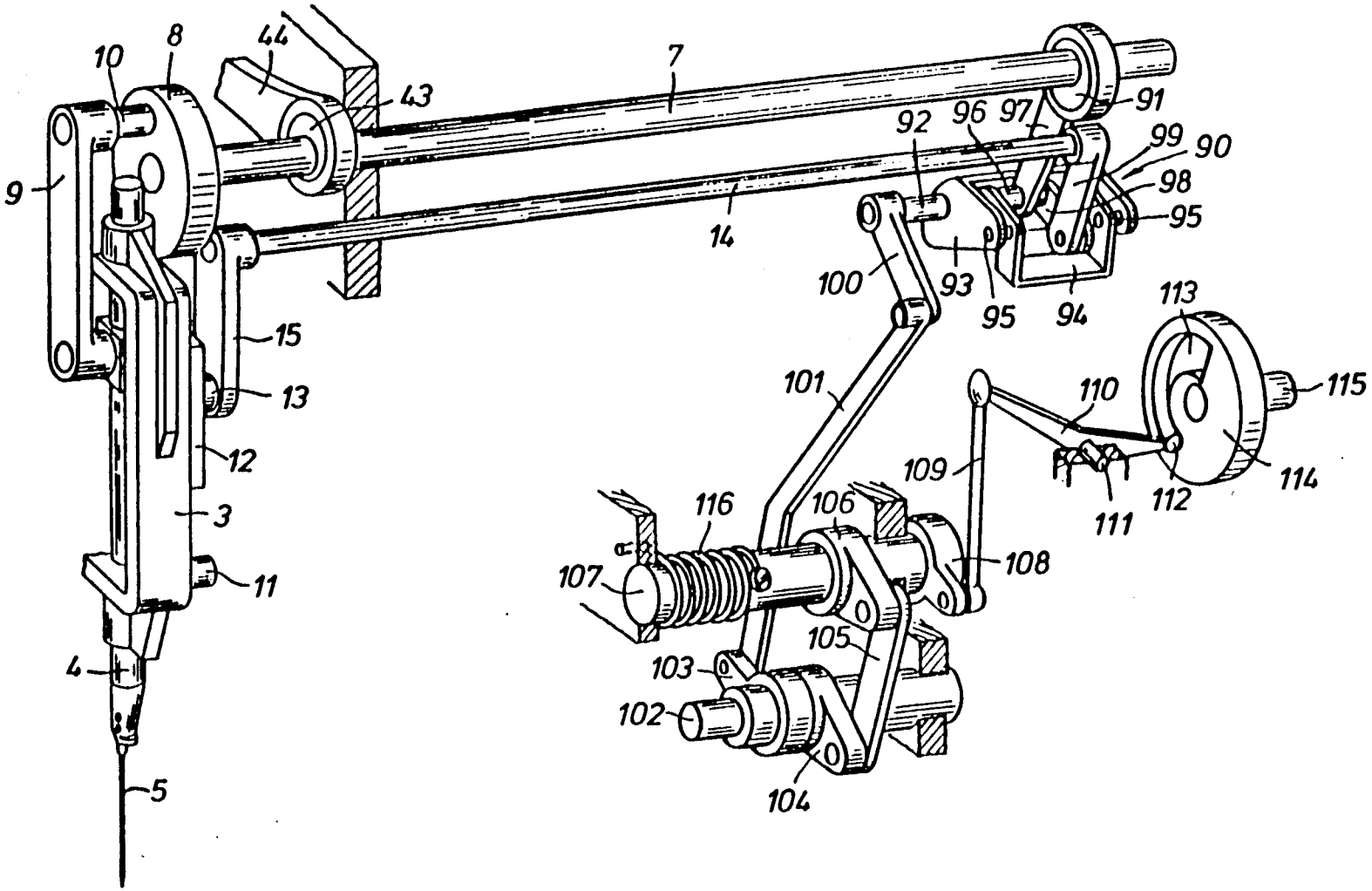
FIG. 2 is a schematic representation of the drive parts for the upper feed mechanism and its adjustment according to the invention.

The housing of the sewing machine also accommodates a main shaft 7 driven in the usual manner (FIG. 2), which drives the needle bar 4 via a crank 8 and a connecting rod 9. The connecting rod 9 is mounted on a pin 10 fastened in the crank 8.

The needle bar holder 3 oscillating around a pivot pin 11 is mounted in the housing of the sewing machine. This needle bar carries, on its rear side, a connecting link guide 12, into which a pin 13 of a crank 15 connected to a rocking shaft 14 extends.

As is apparent from FIG. 1, a pin 18 of a holder 19, which has a bearing eye 20 for receiving the presser foot 1, is fastened in the presser foot bar 2, whose lower end is made hollow. The presser foot is pivotably mounted in the bearing eye 20 and has an annular plate 21 which surrounds a downwardly directed pin 22 that is fastened on the support 19 and extends coaxially with the pin 18. The annular plate 21 is tensioned by a compression spring 23 arranged on the pin 22 and by a spring plate 25 supported against a locking washer 24 on the end of the pin 22.

With its upper end, the presser foot bar 2 is hinged to a triangular lever 27 via a joint plate 26. An upper feed rod 29, which is displaceably mounted in the needle bar holder 3, is hinged to this triangular lever via another joint plate 28. This upper feed bar has a hole 30, in which a rod part 31 is guided. The upper feed foot 6 is fastened at the lower end of this bar part. The bar part 31 is provided with a slotted hole 32, through which extends a pin 33 fastened transversely in the upper feed bar 29. A pin 34 connected to it in the axial extension of the bar part 31 is guided in an inner projection 35 of the hole 30. A spring 36 is mounted on the pin 34 between the bar part 31 and the inner projection 35. A second spring 37 is arranged between the inner projection 35 and a screw 38 screwed into the upper end of the pin 34. The springs 36 and 37 hold the upper feed foot 6 in a predetermined middle position.

The triangular lever 27 is connected via a hinge pin 39 to an arm 40 which is mounted on a pin 41 fastened in the housing of the sewing machine.

The up and down movement of the presser foot 1 and of the upper feed foot 6 are generated by an eccentric 43 fastened on the main shaft 7 (cf. FIG. 2), which is connected via an eccentric rod 44 to an arm 45*a* of an angle lever 45. This angle lever is mounted on a pin 46, which is made in one piece with the housing, and its other arm 45*b* is connected to the triangular lever 27 via a coupler 47 and a bearing journal 48.

Figure 3:
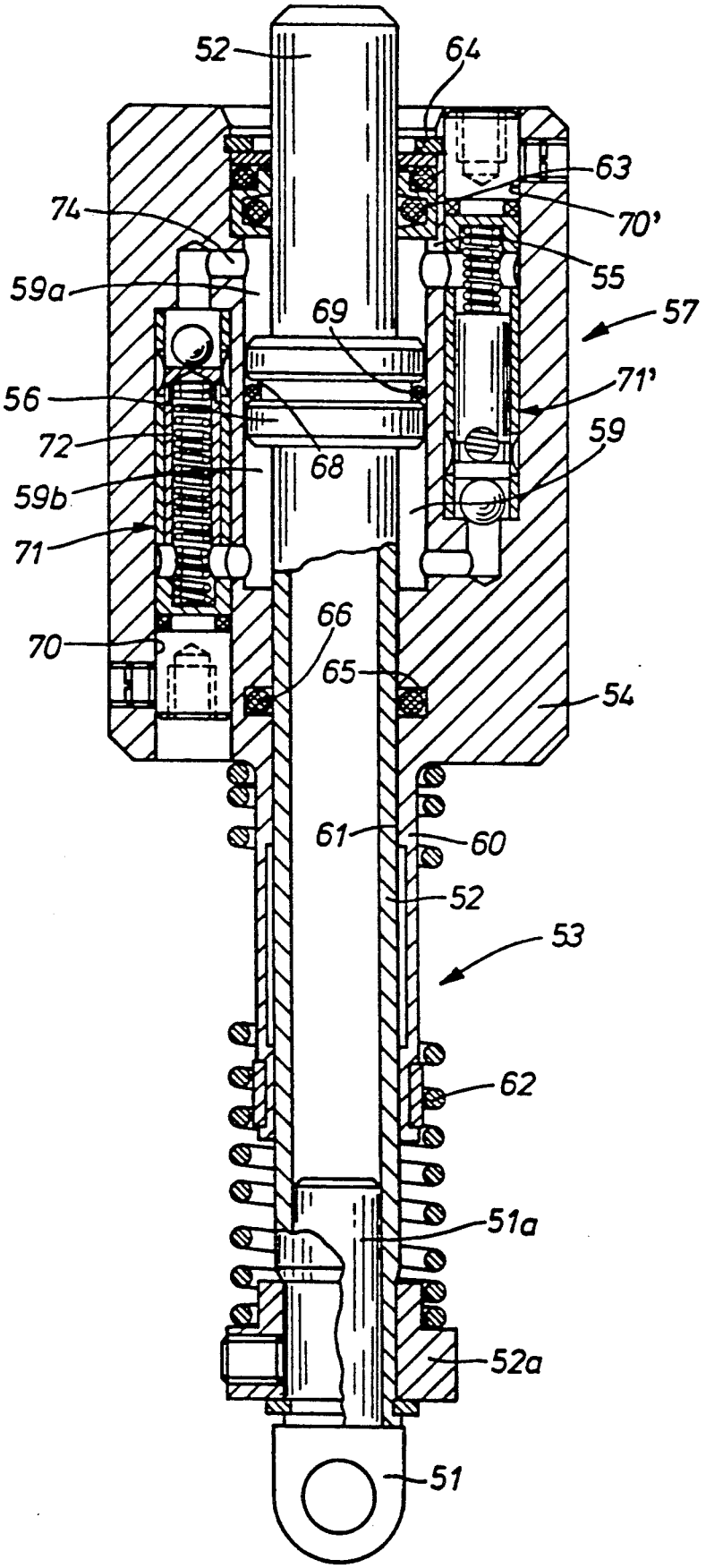
FIG. 3 is an enlarged detail of the level control for the upper feed foot and the presser foot according to the invention.
Figure 5:
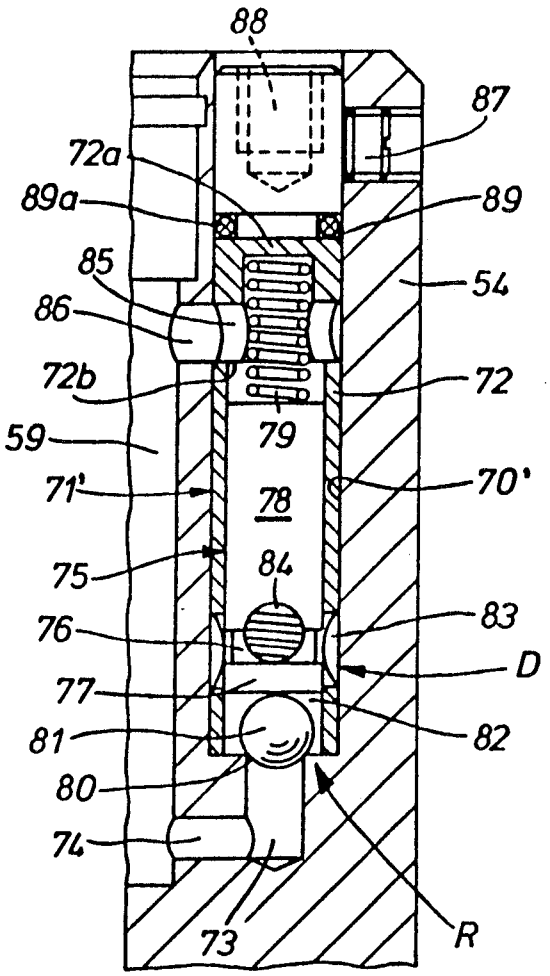
FIGS. 4 and 5 show enlarged representations of the sections of the pressure relief valves shown in FIG. 3.

The hinge pin 39 is connected to a hinge connection 51 via a bracket pair 49, of which only the front bracket is shown, and via a bolt 50. This hinge connection is fastened with a pin 51*a* (FIG. 3) in a piston rod 52, which is part of a drive connection 53, which comprises a servo mechanism 57 consisting of a housing 54, a hydraulic cylinder 55, and an adjusting piston 56.

The housing 54 is fastened in the housing of the sewing machine with a bolt 58. It has an internal cylinder chamber 59, and is connected to a pipe section 60 whose hole 61 is extended to the cylinder chamber 59. A piston rod 52 carrying the adjusting piston 56 is guided in the hole 61. The adjusting piston 56 is displaceably arranged in the cylinder chamber 59, and subdivides it into an upper chamber and a lower chamber 59*a* and 59*b*, respectively.

At the lower end of the piston rod 52, a flange 52*a* is fastened; a compression spring 62 guided on the tube section 60 is in contact with one end of the flange, and the other end of the flange is supported by the lower part of the housing 54.

The piston rod 52, which is extended in the upward direction, is passed through a packing sleeve 63 which closes off the cylinder chamber 59 and is locked secured in its axial position by a locking washer 64. The two chambers 59*a* and 59*b* are sealed in the upward and downward directions by the packing sleeve 63 as well as a sealing ring 66 inserted into a groove 65 in the tube section 60.

The two chambers 59*a* and 59*b* are filled with oil which is fed in from a reservoir (not shown) that is connected to the connection pipe 67 through the connection pipe 67 (represented in FIG. 1) fastened in the housing 54 of the cylinder 55 via a hole (not shown) extending into the lowermost part of the lower chamber 59*a*. The connection pipe 67 has a ball valve acting in one direction, so that oil is automatically drawn in from the reservoir in the case of loss of oil due to leaks as a consequence of the vacuum generated during the upward movement of the adjusting piston 56.

An annular groove 68 with a sealing ring 69 is provided in the circumference of the middle part of the adjusting piston 56 in order to prevent oil from being exchanged over the circumference of the adjusting piston 56 during its displacement.

Laterally from the cylinder 59, two holes 70, 70' extending in parallel to its axis, in which one pressure relief valve 71, 71' each is accommodated, are provided in the housing 54. The two pressure relief valves 70, 71' have identical design, but are installed in their holes 70, 70' such that they function in opposite directions. Therefore, only the design of the pressure relief valve 71 will be described.

This pressure relief valve 71 has a sleeve 72, which is fastened in the hole 70 (FIG. 4), is open at one of its ends and is closed at its other end. Its open end is connected to the chamber 59*a* via a canal 73 extending coaxially with the hole 70 and via a canal 74 extending at right angles thereto.

A partially hollow cylinder 75, which is separated by an annular groove 76 into a piston 77 and a piston guide 78, is guided in the sleeve 72. The hole inside the sleeve 72 is also reduced in the zone of the closed end, so that improved guiding is achieved for the end of a compression spring 79, which is in contact with the bottom 72*a* of the sleeve 72, lies against the piston 77 with its other end, and presses a ball 81 arranged between the piston and an opening 80 of the canal 73 against the opening 80. Thus, a chamber 82 is formed between the opening 80 and the piston 77. The compression spring 79, the piston 77, the ball 81, and the opening 80 form a check valve R.

Figure 4:
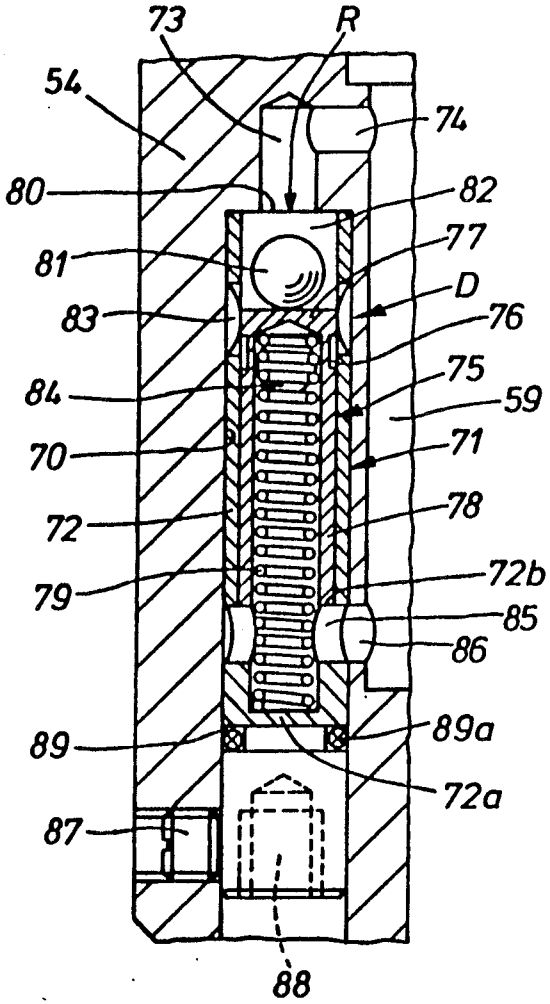

In the working zone of the piston 77, a cross hole 83 is arranged in the sleeve 72 such that in one end position of the piston 77, in which the ball 81 is seated on the opening 80, it is separated from the chamber 82 by part of the piston 77. In the state in which the piston 77 is lifted off from the ball 81, this piston 77 releases the path from the chamber 82 to the cross hole 83, as is shown in FIG. 4. The length of the piston 77 is shorter than the diameter of the cross hole 83, so that in the lifted-off state of the piston 77, oil is able to flow from the chamber 82 via the cross hole 83 into the annular groove 76, in whose zone the sleeve 72 has a cross hole 84. A pressure limiting valve D located downstream of the check valve R is formed by the compression spring 79, the piston 77, and the cross sections 83 and 84.

In its offset part, the sleeve 72 contains a stop edge 72*b* for limiting the stroke of the piston guide 78, as well as another cross hole 85 which is connected to the chamber 59*b* via a canal 86. Using a screw 87 provided in the housing 54, the sleeve 72 can be fixed by means of a tool engaging a hexagonal socket 88 after its rotated position has been set. The sleeve 72 also has a groove 89, in which a sealing ring 89*a* is located.

The pushing drive of the upper feed foot 6 is ensured by a stitch length-regulating mechanism 90 (FIG. 2), which is connected to an eccentric 91 fastened on the main shaft 7. The stitch length-regulating mechanism 90 has an adjusting shaft 92, which is mounted in the housing and is rigidly connected to a bail 93, between the arms of which another bail 94 is rotatably mounted on a pin 95. The arms of the bail 94 are connected by a bolt 96 to which an eccentric rod 97 is hinged. The eccentric 91, which is surrounded by the eccentric rod 97, imparts rocking movements around the pins 95 to the bolt 96.

A connecting rod 98, one end of which acts on the bolt 96, is hinged at its other end to a lever arm 99, which is fastened at one end of the rocking shaft 14 mounted in the housing in parallel to the main shaft 7.

A lever arm 100, which is connected via a connecting rod 101 to a crank 103 fastened to an adjusting shaft 102, is fastened on the adjusting shaft 92 of the stitch length-regulating mechanism 90.

An adjusting crank 104, which is connected to an intermediate shaft 107 mounted in the housing via an intermediate member 105 and another adjusting crank 106, is clamped onto the adjusting shaft 102 mounted in the housing. A lever 108 is fastened on this intermediate shaft 107. The lever 108 is connected via a ball type tie rod 109 to one end of a rocking lever 110, which is pivotable around an axis 111 that is a rigid part of the housing. The still free end of the rocking lever 110 has a spherical projection 112 and extends into an adjusting cam 113 of an adjusting wheel 114 which can be fixed and is arranged on an axis 115 that is a rigid part of the housing. The adjusting curve 113 in the adjusting wheel 114 extends helically to its axis 115, so that stitch lengths of, e.g., 1–6 mm can be set on the upper feed foot 6. A spring 116, which surrounds the intermediate shaft 107 and one end of which is fastened in the housing, keeps the projection 112 of the rocking lever 110 constantly in contact with one of the side walls of the adjusting cam 113.

The adjusting shaft 102 is connected to the lower feed dog (not shown) in the usual manner, so that both the upper feed foot 6 and the lower feed dog are adjusted synchronously with one another when adjusting the adjusting wheel 114.

A shaft 117, which is rigidly connected to a hand lever 118, is mounted in a projection of the housing of the sewing machine (FIG. 1). A cam segment 119 is fastened beneath the arm 40 on the end of the shaft 117 extending into the housing.

The mechanism operates as follows:

The amount of feed of the upper feed foot 6 (FIGS. 1 and 2) and the needle 5 are set by rotating the adjusting wheel 114, as a result of which the adjusting cam 113 will correspondingly rotate the intermediate shaft 107 via the rocking lever 110.

The intermediate shaft 107 will now adjust the adjusting shaft 102 via the intermediate member 105 and the adjusting shaft 92 via the connecting rod 101 and the lever arm 100. It is achieved due to this arrangement that when adjusting the adjusting wheel 114, the feed setting of the upper feed foot 6 is changed synchronously with the feed setting of the lower feed dog via the adjusting shaft 102.

The movement derived from the eccentric 91 is transmitted to the needle bar holder 3 via the drive connection consisting of the eccentric rod 97, the bolt 96, the connecting rod 98, the lever arm 99, the rocking shaft 14, the crank 15, the pin 13), and the connecting link guide 12, as a result of which the needle bar holder 3 will impart a corresponding feed movement to both the needle bar 4 and the upper feed foot 6.

Via the eccentric 43, the eccentric rod 44 is driven synchronously with the feed movement of the upper feed foot 6, and the eccentric rod 44 rotates the triangular lever 27 via the angle lever 45 and the coupler 47 around the hinge pin 39, which is guided by the arm 40 that is rigidly mounted in the housing.

The up and down movements of the two sewing feet (the upper feed foot 6 and the presser foot 1) and consequently also their contact pressure on the fabric are produced by the oscillating rotary motion of the triangular lever 27. The contact pressure is predetermined by the pressure of the springs 23 and 36 of the two sewing feet and the pressure exerted via the drive connection 53, as will be explained below in greater detail.

The drive connection 53 acts on the hinge pin 39 and consequently also on the triangular lever 27 via the pair of brackets 49 with a force determined by the compression spring 62. Depending on the pivoted position of the triangular lever 27, the force is transmitted from this triangular lever 27 to one sewing foot or to both sewing feet (the upper feed foot 6 and the presser foot 1). The two springs 23 and 36 act as working springs. They are compressed individually or both together to different extents, and they press the sewing feet onto the material to be sewn with a predetermined pressing force. The springs 25 and 37 are stop springs for avoiding rebound shocks during the lifting off of the respective sewing foot. A mean value of the impulse-like forces of reaction acting on the sewing feet becomes established during the operation of the sewing machine. This mean value is transmitted via the pair of brackets 49 to the piston rod 52. The forces of reaction of both sewing feet, which occur in a pronounced pulse- like form, induce rhythmic movement impulses on the drive connection. They are greatly damped by their specific design. The drive connection 53 thus remains relatively rigid under constant sewing conditions, and only the sewing feet proper will perform up and down movements.

If disturbances occur due to a change in the thickness of the material being sewn, the forces of reaction acting on the sewing feet and consequently on the springs 23 and 36 will change as well. As a result, the force acting on the piston rod 52 will be correspondingly increased. For example, at the time of transition to a thicker material to be sewn, the springs 23 and 36 of the sewing feet (1 and 6) will first be compressed more intensely, as a result of which the forces will be transmitted to the piston rod 52 via the drive mechanism. The adjusting piston 56 increases the pressure exerted on the oil in the upper chamber 59*a*. The oil pressure is transmitted via both the canals 74 and 73 (FIG. 4) to the surface of the ball 81 lying on the opening 80, which surface is located within the opening 80. Corresponding to the pre-tension of the compression spring 79, the ball 81 is lifted off from the opening 80 at a predetermined oil pressure, the opening pressure. After a short lift-off movement of the ball 81, the oil pressure is transmitted to the surface of the piston 77. Since this surface is larger than the surface of the opening 80, a holding pressure that is smaller according to the ratio of the two surfaces will become established, i.e., a higher opening pressure is first necessary for opening the pressure relief valve 71, after which the pressure will drop to a lower holding pressure. At this lower pressure level, the piston 77 will continue to move against the force of the compression spring 79. The force of this spring can be assumed to be approximately constant during this short opening movement. The piston 77 will now move as long as its front edge has moved into the zone of the cross hole 83, as is shown in FIG. 4. In this position, the oil is able to enter the interior of the piston guide 78 around the ball 81, through the cross hole 83, around the piston 77, via the annular groove 76, and the cross hole 84. From here, the oil stream is able to flow off into the lower chamber 59*b* through the cross hole 85 and the canal 86. The adjusting piston 56 (FIG. 3) is able to yield to the force of reaction from the bottom, and will be displaced in the upward direction until an approximate equilibrium of forces has become established between the dynamic mean value of the forces acting on the piston rod 52 from the bottom and the static opposing force of the compression spring 62.

As soon as the compressive force of the oil on the surface of the piston 77 (FIG. 4) is lower than the compressive force of the spring 79, the latter will displace the piston 77, which will again close the opening 80 via the ball 81, as a result of which the adjusting piston 56 will be hydraulically blocked in the new position.

In the case of transition from a thicker to a thinner material to be sewn, the forces of reaction acting on the piston rod 52 drop below their normal values, after which the pressure relief valve 71' will be activated, and exchange of oil from the lower chamber 59*b* into the upper chamber 59*a* will take place in the same manner as was described in connection with the pressure relief valve 71.

The upward movement of the piston 77 is first blocked until the higher opening force needed to lift off the ball 81 is reached in the pressure relief valve 71'. The piston rod 52 is now able to move in the upward direction with reduced piston force. After pressure equalization, the pressure relief valve 71' is again closed.

The ratio of the opening pressure level for the two pressure relief valves 71 and 71' to the holding pressure level is reciprocal to the ratio of the surface of the opening 80 to the surface of the piston 77. The ratio of the opening pressure level to the holding pressure level can be changed by designing these surfaces differently. In addition, a change in the pressure of response of the respective pressure relief valve 71 or 71' can be achieved by replacing the compressive force 79. Thus, it is possible to achieve symmetrical response of the two pressure relief valves 71 and 71' working in the antiparallel mode or different response characteristics of both pressure relief valves 71 and 71'.

The lifting movement of the lower feed dog above the needle plate causes, via the sewing feet 1 and 6, a minimal rhythmic vertical displacement of the piston rod 52. The amount of this lifting movement is so small that the alternating pressure increase exerted by it via the adjusting piston 56 on the oil reserve in the chambers 59*a* and 59*b* is not sufficient for opening the pressure relief valves 71 and 71' during normal operation of the sewing machine.

To lift the sewing feet (the upper feed foot 6 and the presser foot 1), the hand lever 118 is pivoted in the upward direction. As a result, the cam segment 119 pushes the arm 40 in the upward direction, and the arm 40 also seeks to push the adjusting piston 56 in the upward direction via the bracket pair 49 and the piston rod 52. The pressure relief valve 71 will open under the effect of the pressure exerted on the opening 80, as a result of which the two chambers 59*a* and 59*b* will be connected to one another in the above-described manner, and exchange of oil is able to take place until the adjusting piston 56 reaches the position determined by the end position of the arm 40.

The sewing feet are lowered by pivoting the hand lever 118 in the downward direction, as a result of which the cam segment 119 will release the arm 40. The pre-tension produced by the compression spring 62 is now able to push the piston rod 52 with the adjusting piston 56 in the downward direction, as a result of which the two chambers 59*a* and 59*b* will be connected to one another via the pressure relief valve 71'. After one or both the sewing feet touch down on the needle plate or the material to be sewn, the force of reaction thus produced and exerted to the piston rod 52 will bring about closing of the pressure relief valve 71' in the above-described manner.

While a specific embodiment of the invention has been shown and described in detail to illustrate the application of the principles of the invention, it will be understood that the invention may be embodied otherwise without departing from such principles.

I claim:

1. A sewing machine, comprising:

an upper feed system including an upper feed mechanism having an upper feed foot, a presser foot mechanism having a presser foot, and a lifting drive and a pushing drive for the upper feed foot, said lifting and pushing drive including a support which is adjustable in height via a drive connection connected to a housing of the sewing machine, said drive connection including hydraulic control means with a hydraulic cylinder and an adjusting piston, a force of reaction arising from a lifting force acting on said upper feed foot and on said presser foot during a sewing process being imparted via a linkage connection to said adjusting piston, said adjusting piston subdividing said hydraulic cylinder into a first chamber and a second chamber, and pressure relief means including a first pressure relief valve connecting said two chambers, acting in one direction and a second pressure relief valve connecting said two chambers, acting in an opposite direction.

2. A sewing machine according to claim 1, wherein:

each of said pressure relief valves include a spring-tensioned check valve and a pressure limiting valve arranged downstream of said check valve.

3. A sewing machine according to claim 1, wherein;

each of said pressure relief valves includes a sleeve positioned with a hole formed in a housing of the hydraulic cylinder, each end of said sleeve is connected via an oil passage opening to one of said chambers of said hydraulic cylinder, and a spring-tensioned piston, supported by a ball covering an oil passage opening, is displaceably mounted in said sleeve, and said piston being arranged in a transition zone with respect to a cross hole in said sleeve, whose diameter is larger than a length of the piston.

* * * * *